US009643813B2

(12) United States Patent
Kugimiya et al.

(10) Patent No.: US 9,643,813 B2
(45) Date of Patent: May 9, 2017

(54) PAPER FOLDING APPARATUS AND IMAGE FORMING APPARATUS

(71) Applicant: Konica Minolta, Inc., Chiyoda-ku (JP)

(72) Inventors: Isamu Kugimiya, Toyokawa (JP); Masato Niizuma, Minato-ku (JP); Yusuke Hirano, Toyohashi (JP); Kunihiko Kanou, Tokoname (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/608,277

(22) Filed: Jan. 29, 2015

(65) Prior Publication Data

US 2015/0217964 A1 Aug. 6, 2015

(30) Foreign Application Priority Data

Feb. 6, 2014 (JP) ..... 2014-020887

(51) Int. Cl.
*B65H 37/06* (2006.01)
*B65H 45/18* (2006.01)

(52) U.S. Cl.
CPC ..... *B65H 45/18* (2013.01); *B65H 2801/27* (2013.01)

(58) Field of Classification Search
CPC ..... B65H 37/06; B65H 45/18
USPC ..... 270/32, 39.08
See application file for complete search history.

(56) References Cited

U.S. PATENT DOCUMENTS 3,630,514 A * 12/1971 Del Vecchio ..... B65H 29/60 493/23
3,632,104 A * 1/1972 Dufour ..... B65H 45/18 493/444
3,745,892 A * 7/1973 Ganz ..... B31B 1/56 493/125
4,109,902 A * 8/1978 Barrer ..... B65H 45/20 493/444

(Continued)

FOREIGN PATENT DOCUMENTS

JP S47-18009 Y1 6/1972
JP 2-110078 A 4/1990

(Continued)

OTHER PUBLICATIONS

Notice of Reasons for Rejection dated Dec. 8, 2015 issued in the corresponding Japanese Patent Application No. 2014-020887 (6 pages).

*Primary Examiner* — Patrick Mackey
(74) *Attorney, Agent, or Firm* — Buchanan Ingersoll & Rooney PC

(57) ABSTRACT

A paper folding apparatus includes: a pair of folding rollers driven in a rotational manner; a carrying roller configured to carry paper in such a manner that the paper passes near a nip part of the pair of folding rollers; a unit configured to form, near the nip part, deflection of the paper carried by the carrying roller toward the nip part; a pushing member which is configured to push the paper, which is carried by the carrying roller, toward the nip part of the folding rollers, the pushing member being provided in a manner movable from a position retracted from a carrying path of the paper toward the nip part; a drive unit configured to generate driving force to move the pushing member; and an elastic member configured to transmit the driving force from the drive unit to the pushing member.

10 Claims, 6 Drawing Sheets

(56) References Cited

U.S. PATENT DOCUMENTS

| | | | | | |
|---|---|---|---|---|---|
| 4,175,740 | A * | 11/1979 | Klenk | B65H 45/18 | 493/435 |
| 4,338,088 | A * | 7/1982 | Buss | B65H 45/04 | 414/794 |
| 4,419,088 | A * | 12/1983 | Nemec | B65H 45/18 | 493/444 |
| 4,995,600 | A * | 2/1991 | Kovac | B65H 45/18 | 270/45 |
| 5,092,833 | A | 3/1992 | King et al. | | |
| 5,779,232 | A | 7/1998 | Öchsner | | |
| 5,989,174 | A * | 11/1999 | Patrizio | B31F 1/0009 | 493/413 |
| 8,900,110 | B2 * | 12/2014 | Jung | B65H 45/18 | 493/360 |

FOREIGN PATENT DOCUMENTS

| | | | |
|---|---|---|---|
| JP | 9-503472 | A | 4/1997 |
| JP | 2002-284443 | A | 10/2002 |
| JP | 2005-231777 | A | 9/2005 |
| JP | 2011-241045 | | 12/2011 |

* cited by examiner

PAPER FOLDING APPARATUS AND IMAGE FORMING APPARATUS

The entire disclosure of Japanese Patent Application No. 2014-020887 filed on Feb. 6, 2014 including description, claims, drawings, and abstract are incorporated herein by reference in its entirety.

BACKGROUND OF THE INVENTION

Field of the Invention

The present invention relates to a paper folding apparatus to fold paper at a predetermined position and an image forming apparatus including such a paper folding apparatus. Specifically, when paper is folded by forming deflection of paper between a pair of folding rollers driven in a rotational manner, pushing the deflection part of the paper toward a nip part of the folding rollers by a pushing member driven by a drive unit, and guiding the deflection part of the paper to the nip part of the folding rollers driven in a rotational manner, even in a case where various kinds of paper having different kinds of basis weight or the like is used, it is made possible to fold the various kinds of paper at a predetermined position adequately with a simple configuration.

Description of the Related Art

In the related art, paper is folded at a predetermined position by a paper folding apparatus. For example, when a booklet or the like is formed, after an image is formed on large paper by an image forming apparatus such as a copier, the large paper is folded at a predetermined position by a paper folding apparatus.

Here, in such a paper folding apparatus, generally, a leading end of paper is carried through a gap between a pair of folding rollers. Then, the leading end of the paper is abutted on a stopper or the like and stopped at a predetermined position. Deflection is formed at a part of the paper between the pair of folding rollers and the deflection part of the paper is guided to a nip part of the pair of folding rollers driven in a rotational manner, whereby the paper is folded.

However, a shape of the deflection formed at the part of the paper between the pair of folding rollers is not fixed. For example, the shape of the deflection varies depending on a kind or basis weight of the paper or an environmental condition. In this state, when the deflection part of the paper is guided to the nip part of the pair of folding rollers driven in a rotational manner and the paper is folded, a fold position of the paper is not fixed. Specifically, there has been a problem that a fold position of thick paper having high basis weight and high stiffness and that of thin paper having low basis weight and low stiffness are different from each other.

Then, in the related art, as described in JP 2002-284443 A, the following has been proposed. That is, in a state in which a leading end of paper is abutted on a stopper or the like and is stopped at a predetermined position, deflection part of the paper is formed between a pair of folding rollers and the deflection part of the paper is guided to a nip part of the pair of folding rollers, which is driven in a rotational manner, by a bend part of a fold position regulation member.

However, in what described in JP 2002-284443 A, a relationship between a speed to form deflection of paper at a part between a pair of folding rollers and a speed to push out the deflection part of the paper toward a gap between the folding rollers by a bend part of a fold position regulation member is not considered at all.

Thus, when the speed to push out the deflection part of the paper toward the gap between the folding rollers by the bend part of the fold position regulation member becomes higher than the speed to form the deflection of the paper, there has been the following problem. That is, the paper is pushed by the bend part of the fold position regulation member and a position of a leading end of the paper abutted on a stopper or the like is shifted, and thus, a position of the paper guided to a nip part of the pair of folding rollers is shifted and it becomes not possible to fold the paper at an adequate position in the nip part of the folding rollers.

On the other hand, when the speed to form the deflection of the paper becomes higher than the speed to push out the deflection part of the paper toward the gap between the folding rollers by the bend part of the fold position regulation member, there has been the following problem. That is, before the deflection part of the paper is pushed out toward the gap between the folding rollers by the bend part of the fold position regulation member, the deflection part of the paper is guided to the nip part of the folding rollers and a position of the paper guided to the nip part of the pair of folding rollers is not fixed, and thus, it becomes not possible to fold the paper at an adequate position in the nip part of the folding rollers.

Also, in JP 2-110078 A, the following has been proposed. That is, paper carried along a carrying track through a gap between a pair of folding rollers is detected by a sensor. The result is output to a simultaneous circuit storing a folding form or the like and a redirecting mechanism is moved toward the gap between the folding rollers by controlling of rotation of a cam or the like based on the result. The paper carried along the carrying track by the redirecting mechanism is guided to the gap between the folding rollers and the paper is folded in a nip part of the folding rollers.

However, it is very difficult to perform control, by the simultaneous circuit storing a folding form or the like as described above, to move the redirecting mechanism toward the gap between the folding rollers by controlling rotation of the cam or the like and to guide the paper, which is carried along the carrying track, to an adequate fold position toward the gap between the folding rollers. Thus, a configuration to perform the control becomes complicated, and thus, there has been a problem that a cost is increased and an apparatus becomes large, for example.

SUMMARY OF THE INVENTION

The present invention is to solve the foregoing problems in a paper folding apparatus to fold paper at a predetermined position.

Then, an object of the present invention is to provide a paper folding apparatus to fold paper by forming deflection of the paper between a pair of folding rollers driven in a rotational manner, pushing the deflection part of the paper toward a nip part of the folding rollers by a pushing member driven by a drive unit, and guiding the deflection part of the paper to the nip part of the folding rollers driven in a rotational manner, even when various kinds of paper having different kinds of basis weight or the like is used, so as to fold the various kinds of paper adequately at a predetermined position and to reduce variation in a fold position with a simple configuration.

To achieve the abovementioned object, according to an aspect, a paper folding apparatus reflecting one aspect of the present invention comprises: a pair of folding rollers driven in a rotational manner; a carrying roller configured to carry paper in such a manner that the paper passes near a nip part of the pair of folding rollers; a unit configured to form, near the nip part, deflection of the paper carried by the carrying roller toward the nip part; a pushing member which is configured to push the paper, which is carried by the carrying roller, toward the nip part of the folding rollers, the pushing member being provided in a manner movable from a position retracted from a carrying path of the paper toward the nip part; a drive unit configured to generate driving force to move the pushing member; and an elastic member configured to transmit the driving force from the drive unit to the pushing member.

In such a manner, when a pushing member retracted from a carrying path of paper is moved toward a nip part of folding rollers by the drive unit via an elastic member and deflection part of the paper is pushed toward the nip part of the folding rollers by the pushing member due to elastic force of the elastic member deformed by the drive unit, even in a case where a speed to form the deflection of the paper and a speed to push out the deflection part of the paper toward a gap between the folding rollers by the pushing member are not made identical to each other securely, impact force of the pushing member abutted on the paper is reduced due to the elastic force of the elastic member. Also, a fixed position of the deflection part of the paper is pushed adequately by the pushing member. Thus, even when various kinds of paper having different formation conditions of the deflection is used, it becomes possible to push the deflection part of these kinds of paper adequately toward the nip part of the folding rollers.

Here, as the pushing member, a pushing member rotatable with a fulcrum point as a center is preferably used. In this case, the pushing member retracted from a carrying path of the paper is rotated with the fulcrum point as the center and is moved toward the nip part of the folding rollers.

Also, in a case where a pushing member rotatable in such a manner with a fulcrum point as a center is used, a torsion coil spring is preferably used as the elastic member, rotation caused by the drive unit is preferably transmitted, vi a the torsion coil spring, to the pushing member which rotates with the fulcrum point as the center, and a deflection part of the paper is preferably pushed toward the nip part of the folding rollers by the pushing member due to torsion force of the torsion coil spring twisted by the rotation caused by the drive unit.

Also, in a paper folding apparatus according to an embodiment of the present invention, in a case of forming deflection at a part of paper placed between a pair of folding rollers, an upstream-side carrying unit and a downstream-side carrying unit are respectively preferably provided on an upstream side in a carrying direction of the paper and a downstream side in the carrying direction of the paper relative to the pair of folding rollers. Deflection is preferably formed at a part of the paper placed between the pair of folding rollers by driving the upstream-side carrying unit in the carrying direction of the paper and driving the downstream-side carrying unit in a direction opposite to the carrying direction of the paper in a state in which the paper is carried to a predetermined position by driving the upstream-side carrying unit and the downstream-side carrying unit in the carrying direction of the paper.

Also, as the pushing member, a pushing member including a surface which faces at least one of the folding rollers and which is formed as a curved surface corresponding to an outer peripheral surface of the folding roller is preferably used. In such a manner, when the surface facing the folding rollers is formed as the curved surface corresponding to the outer peripheral surface of the folding roller, deflection part of paper is guided to the gap between the folding rollers along the curved surface of the pushing member. Also, when a surface of the pushing member which surface faces the folding roller placed on the upstream side in the carrying direction of paper is formed as a curved surface corresponding to an outer peripheral surface of the folding roller, in a case where the paper is not to be folded between the pair of folding rollers, it is also possible to guide the paper to the gap between the folding rollers along the curved surface of the pushing member.

Also, in an image forming apparatus according to an embodiment of the present invention, a paper folding apparatus such as what has been described above is preferably included and paper on which an image is formed is folded at a predetermined position by the paper folding apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, a paper folding apparatus and an image forming apparatus according to an embodiment of the present invention will be described in detail with reference to the attached drawings. However, the scope of the invention is not limited to the illustrated examples. Note that the paper folding apparatus and the image forming apparatus according to the present invention are not limited to what is described in the following embodiment and can be modified arbitrarily within the spirit and the scope thereof.

Figure 1:
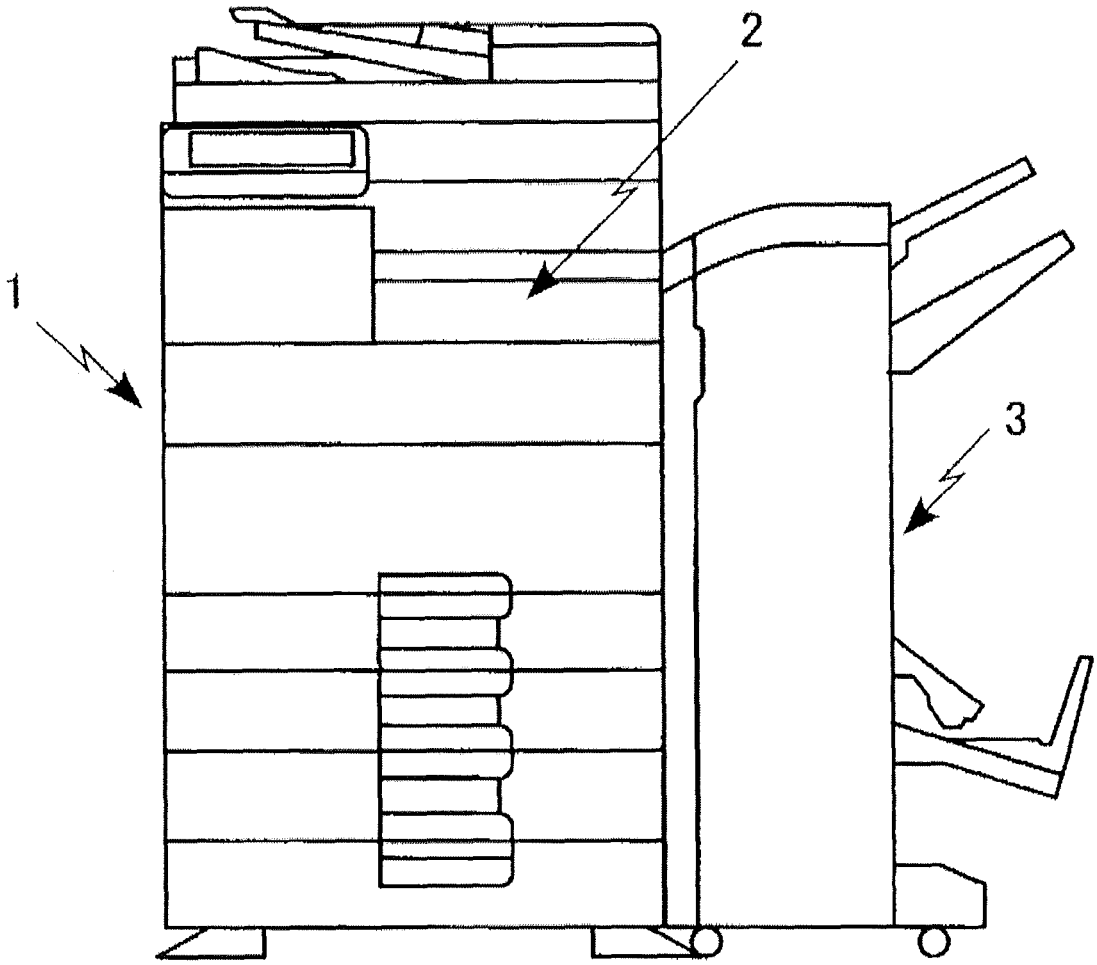
FIG. 1 is a schematic description view illustrating an example of mounting a paper post-processing apparatus, which includes a paper folding apparatus, to an image forming apparatus in an embodiment of the present invention.

In the present embodiment, as illustrated in FIG. 1, a paper post-processing apparatus 3 is connected to an image forming apparatus 1 such as a copier via a horizontal carrying unit 2. Although not illustrated, paper on which an image is formed by the image forming apparatus 1 is fed to the paper post-processing apparatus 3 via the horizontal carrying unit 2. The paper transmitted to the paper post-processing apparatus 3 in such a manner is folded at a predetermined position by a paper folding apparatus 10 which is provided inside the paper post-processing apparatus 3 and which will be described later.

Figure 2:
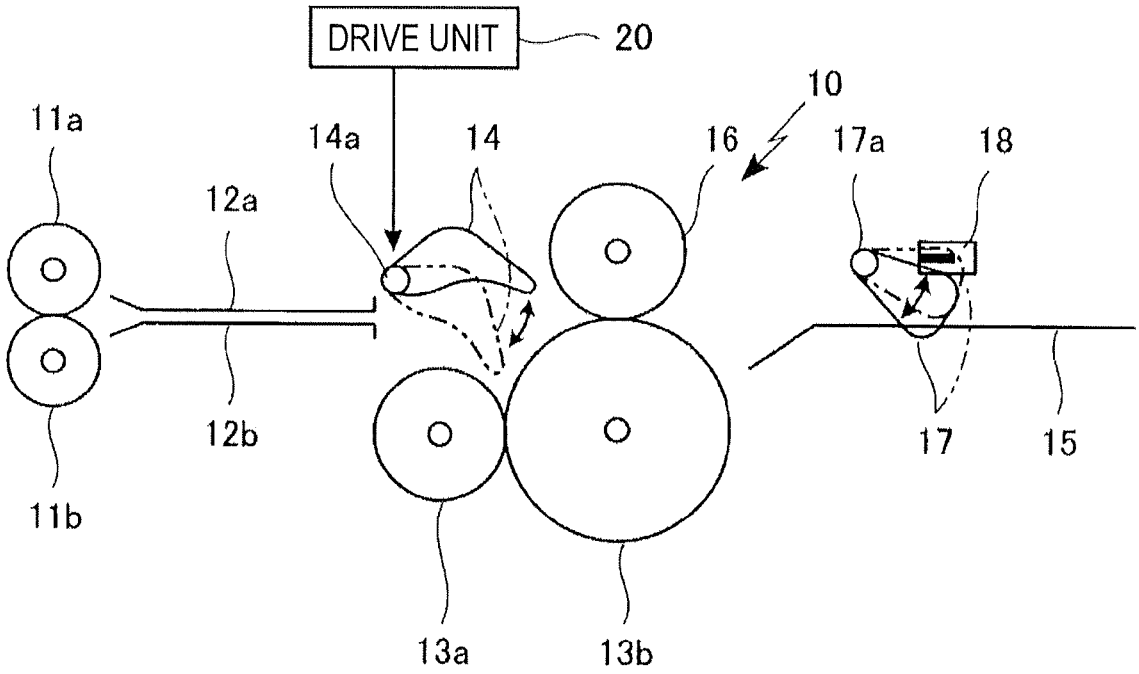
FIG. 2 is a schematic side view of the paper folding apparatus according to the embodiment of the present invention.

Here, as illustrated in FIG. 2, in the paper folding apparatus 10, an upstream-side carrying unit including a pair of upstream-side feeding rollers 11*a* and 11*b* is provided on an upstream side in a carrying direction of paper S. Also, upstream-side guiding members 12*a* and 12*b* which face each other with a predetermined gap therebetween in an up-down direction are provided at a position on a downstream side in the carrying direction of the paper S compared to the upstream-side feeding rollers 11*a* and 11*b*. The upstream-side feeding rollers 11*a* and 11*b* are rotated in the carrying direction of the paper S and the paper is guided to the gap between the upstream-side guiding members 12*a* and 12*b*.

Also, at a position on a downstream side in the carrying direction of the paper S compared to the upstream-side guiding members 12*a* and 12*b*, a pair of folding rollers 13*a* and 13*b* are provided on a lower side of a carrying path of the paper S. A pushing member 14 which is rotated by a drive unit 20 with a fulcrum point 14*a* as a center is rotated downward with the fulcrum point 14*a* as the center from a retracted state on an upper side of the carrying path of the paper S and is moved to a predetermined position near the pair of folding rollers 13*a* and 13*b* on the lower side of the carrying path of the paper S. Here, in the pushing member 14, an acute-angled leading end part away from the fulcrum point 14*a* is formed. Also, when the pushing member 14 is rotated downward and moved to a predetermined position near the pair of folding rollers 13*a* and 13*b*, a surface facing the folding roller 13*a* on the upstream side in the carrying direction of the paper S is formed as a curved surface corresponding to an outer peripheral surface of the folding roller 13*a*.

Then, as described above, the paper S carried between the upstream-side guiding members 12*a* and 12*b* is carried between the pair of folding rollers 13*a* and 13*b* and the pushing member 14 retracted on the upper side of the carrying path.

Also, as a downstream-side carrying unit to carry the paper S, which is carried in such a manner between the pair of folding rollers 13*a* and 13*b* and the pushing member 14 retracted on the upper side of the carrying path, to a downstream-side guiding member 15 provided on the downstream side in the carrying direction of the paper S, the folding roller 13*b* on the downstream side in the carrying direction of the paper S in the pair of folding rollers 13*a* and 13*b* and a downstream-side feeding roller 16 facing the folding roller 13*b* are used. The folding roller 13*b* and the downstream-side feeding roller 16 are rotated in the carrying direction of the paper S and the paper S is guided to the downstream-side guiding member 15. Note that in such a manner, when the folding roller 13*b* on the downstream side in the carrying direction of the paper S is rotated in the carrying direction of the paper S, the pair of folding rollers 13*a* and 13*b* is rotated in a direction opposite to a direction of folding the paper S.

Also, in a case of detecting the paper S guided to the downstream-side guiding member 15 in such a manner and feeding the paper S to a predetermined position, an actuator 17 which rotates with a fulcrum point 17*a* as a center is provided in such a manner as to project downward compared to the downstream-side guiding member 15. The actuator 17 is pushed and rotated upward by the paper S guided by the downstream-side guiding member 15 and the actuator 17 rotated upward in such a manner is detected by a photo-sensor 18. Based on the detection, rotations of the upstream-side feeding rollers 11*a* and 11*b*, the folding roller 13*b* on the downstream side in the carrying direction of the paper S, and the downstream-side feeding roller 16 are controlled by a control unit (not illustrated) and the paper S is fed to the predetermined position.

Figure 3A:
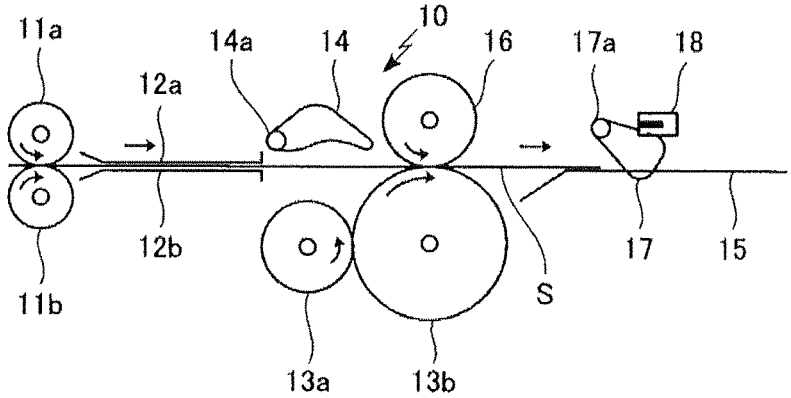
FIG. 3A to FIG. 3D are views illustrating a process to told paper by using the paper folding apparatus according to the embodiment, FIG. 3A being a schematic side view illustrating a state in which a pushing member is retracted on an upper side of a carrying path of paper and the paper is carried to a downstream-side guiding member, FIG. 3B being a schematic side view illustrating a state in which adequate deflection is formed on the paper between a pair of folding rollers after the paper is fed to a predetermined position, FIG. 3C being a schematic side view illustrating a state in which the retracted pushing member is rotated downward and the deflection part of the paper is pushed toward a gap between the pair of folding rollers by a leading end part of the pushing member, and FIG. 3D being a schematic side view illustrating a state in which the deflection part of the paper is folded in a nip of the pair of folding rollers while downward rotation of the pushing member is stopped.

Then, as illustrated in FIG. 3A, in a case of folding the paper S at a predetermined position in the paper folding apparatus 10 in the present embodiment, the upstream-side feeding rollers 11*a* and 11*b*, the folding roller 13*b* on the downstream side in the carrying direction of the paper S, and the downstream-side feeding roller 16 are rotated in the carrying direction of the paper S. By the upstream-side feeding rollers 11*a* and 11*b*, the paper S is made to pass between the upstream-side guiding members 12*a* and 12*b*. Then, the paper S is guided to a gap between the pair of folding rollers 13*a* and 13*b* and the pushing member 14 retracted on an upper side of the carrying path and the paper S made to pass therebetween and guided to a gap between the folding roller 13*b* on the downstream side in the carrying direction of the paper S and the downstream-side feeding roller 16 is carried by the folding roller 13*b* and the downstream-side feeding roller 16 to the downstream-side guiding member 15.

Figure 3B:
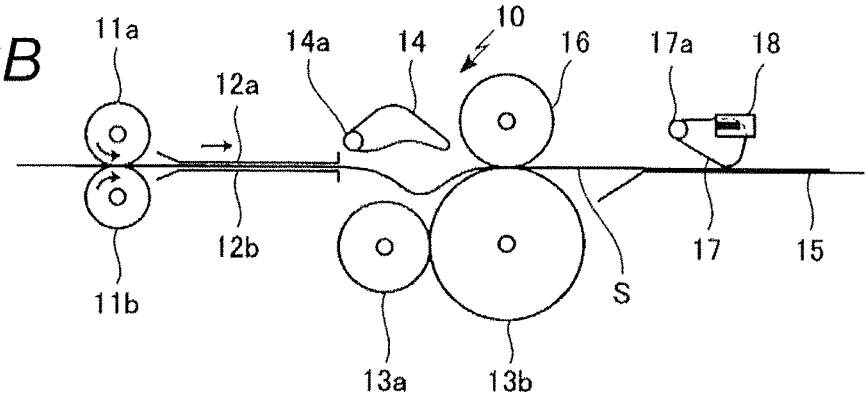

Then, by the paper S carried in such a manner to the downstream-side guiding member 15, the actuator 17 is pushed and rotated upward as described above. When the paper S is fed to a predetermined position after the actuator 17 rotated upward in such a manner is detected by the photo-sensor 18, as illustrated in FIG. 3B, rotations of the upstream-side feeding rollers 11*a* and 11*b* are stopped shortly after rotations of the folding roller 13*b* on the downstream side in the carrying direction of the paper S and the downstream-side feeding roller 16 are stopped. Thus, adequate deflection is formed on the paper S between the pair of folding rollers 13*a* and 13*b*. Note that by performing control to stop the rotations of the upstream-side feeding rollers 11*a* and 11*b* later, the amount of deflection formed between the pair of folding rollers 13*a* and 13*b* can be controlled.

Figure 3C:
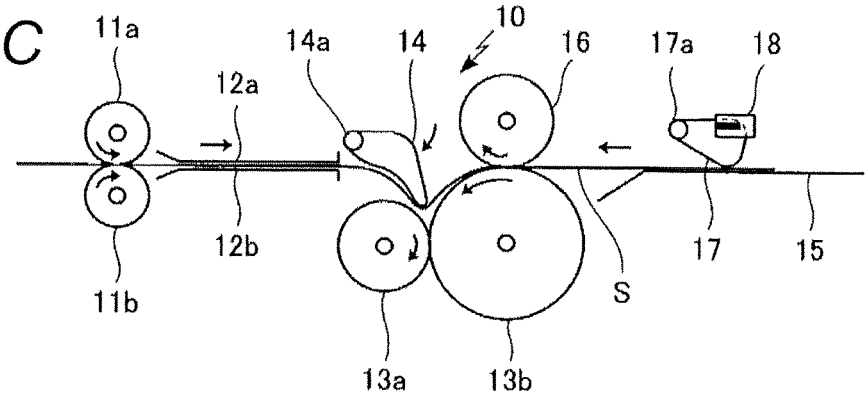

Then, in such a state in which the adequate deflection is formed on the paper S between the folding rollers 13*a* and 13*b*, as illustrated in FIG. 3C, the retracted pushing member 14 is rotated downward by the drive unit 20 with the fulcrum point 14*a* as the center and the acute-angled leading end part of the pushing member 14 is moved toward the deflection part of the paper S. While the upstream-side feeding rollers 11*a* and 11*b* are rotated in the carrying direction of the paper S and the paper S is fed to the pair of folding rollers 13*a* and 13*b*, the pair of folding rollers 13*a* and 13*b* and the downstream-side feeding roller 16 are rotated in a direction opposite to the carrying direction of the paper S. Thus, the paper S guided to the downstream-side guiding member 15 is fed in a direction to be returned to the pair of folding rollers 13*a* and 13*b*, whereby the deflection formed between the pair of folding rollers 13*a* and 13*b* is made larger and the deflection part of the paper S is pushed toward the gap between the pair of folding rollers 13*a* and 13*b* by the leading end part of the pushing member 14 rotated downward as described above.

Figure 3D:
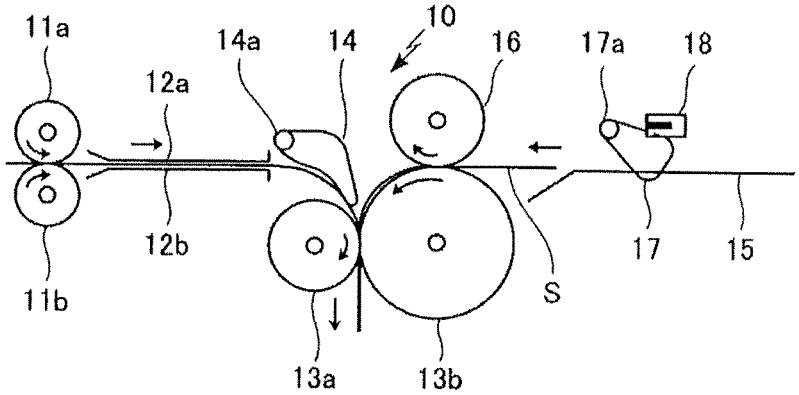

Then, as illustrated in FIG. 3D, the pushing member 14 is stopped by a stopper (not illustrated) in a state in which the leading end pare of the pushing member 14, which is rotated downward and pushes the deflection part of the paper S toward the gap between the pair of folding rollers 13*a* and 13*b*, is near a nip part of the folding rollers 13*a* and 13*b*. In the state, the deflection part of the paper S is guided to the nip of the folding rollers 13*a* and 13*b* and the paper S is folded at the deflection part.

Figure 4A:
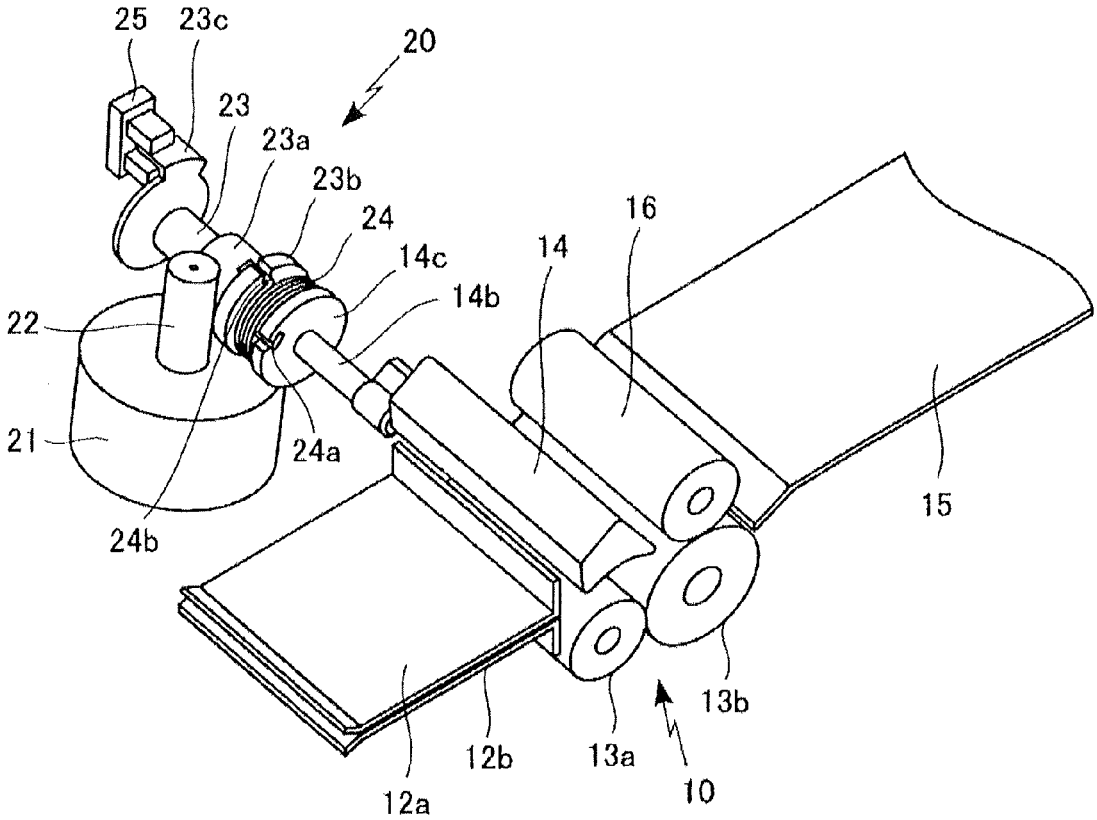
FIG. 4A and FIG. 4B are views illustrating a configuration to rotate the pushing member by a drive unit via an elastic member in the paper folding apparatus according to the embodiment, FIG. 3A being a schematic perspective view and FIG. 3B being a partial perspective view.
Figure 4B:
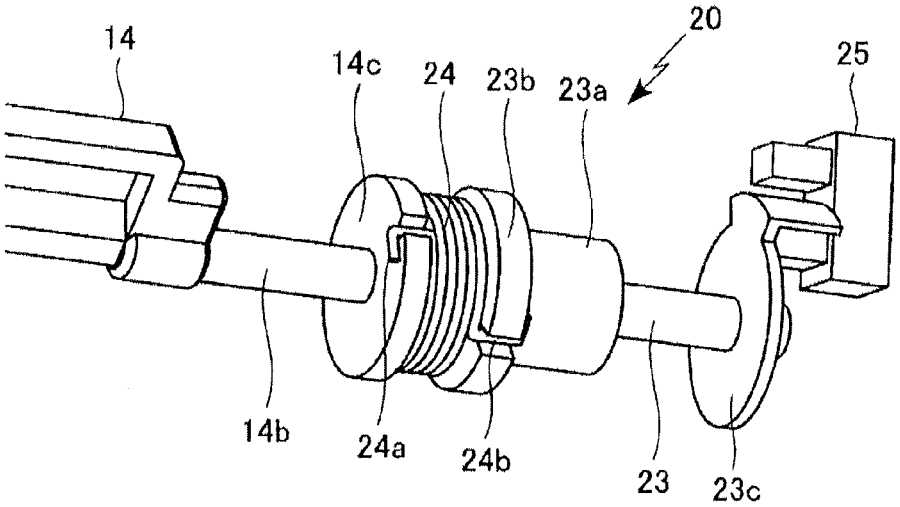

Here, in the paper folding apparatus 10 of the present embodiment, when the pushing member 14 is rotated by the drive unit 20 via the elastic member, as illustrated in FIG. 4A and FIG. 4B, a rotary shaft 14*b* to rotate the pushing member 14 is extended in a direction orthogonal to the carrying direction of the paper S. To a leading end of the rotary shaft 14*b*, a flange 14*c* is provided. To a rotary apparatus 21, a worm gear 22 is provided. To an end part, which is on a side of the pushing member 14, of a rotation transmission shaft 23 to which a worm wheel 23*a* rotated by engagement with the worm gear 22, a flange 23*b* is provided in such a manner as to face the flange 14*c* provided to the rotary shaft 14*b* of the pushing member 14.

Then, a torsion coil spring 24 which is an elastic member is placed between the flange 14*c* provided to the rotary shaft 14*b* and the flange 23*b* provided to the rotation transmission shaft 23. While one end 24*a* of the torsion coil spring 24 is attached to the flange 14*c* provided to the rotary shaft 14*b*, the other end 24*b* of the torsion coil spring 24 is attached to the flange 23*b* provided to the rotation transmission shaft 23. A rotation of the rotation transmission shaft 23 is transmitted to the rotary shaft 14*b* of the pushing member 14 via the torsion coil spring 24.

Also, to an end part, which is on the opposite side of the flange 23*b*, of the rotation transmission shaft 23, a light-shielding member 23*c* is provided. When the pushing member 14 is rotated upward and retracted, the light-shielding member 23*c* is detected by a photo-sensor 25. On the other hand, when the pushing member 14 is rotated downward and the deflection part of the paper S is pushed toward the gap between the pair of folding rollers 13*a* and 13*b* by the leading end part of the pushing member 14, the light-shielding member 23*c* is not detected by the photo-sensor 25. Then, after the deflection part of the paper S is pushed toward the gap between the pair of folding rollers 13*a* and 13*b* by the pushing member 14, the pushing member 14 is rotated upward by the drive unit 20 and the light-shielding member 23*c* is moved back to a position detected by the photo-sensor 25.

When the pushing member 14 is rotated downward by the drive unit 20 and the deflection part of the paper S is pushed toward the gap between the pair of folding rollers 13*a* and 13*b* by the leading end part of the pushing member 14, the worm gear 22 provided to the rotary apparatus 21 is rotated and the rotation transmission shaft 23 is rotated in a direction to rotate the pushing member 14 downward via the worm wheel 23*a* rotated by the engagement with the worm gear 22 and the rotation of the rotation transmission shaft 23 is transmitted to the rotary shaft 14*b* of the pushing member 14 via the torsion coil spring 24.

In such a manner, until the leading end part of the pushing member 14 touches the deflection part of the paper S, the rotary shaft 14*b* of the pushing member 14 is rotated, without much load, along with the rotation of the rotation transmission shaft 23 and the pushing member 14 is rotated downward. On the other hand, when the leading end part of the pushing member 14 touches the deflection part of the paper S and a load is applied between the rotation transmission shaft 23 and the rotary shaft 14*b* of the pushing member 14, the torsion coil spring 24 is twisted by the rotation of the rotation transmission shaft 23 and the rotary shaft 14*b* of the pushing member 14 is rotated while being biased by torsion force of the torsion coil spring 24, whereby the pushing member 14 is rotated downward and the deflection part of the paper S is pushed toward the gap between the pair of folding rollers 13*a* and 13*b* by the leading end part of the pushing member 14.

In such a manner, when the rotation of the rotation transmission shaft 23 is transmitted to the rotary shaft 14*b* of the pushing member 14 via the torsion coil spring 24 and the pushing member 14 is rotated downward, even in a case where a speed to rotate the pushing member 14 downward becomes higher than a speed to form deflection on the paper S, impact force of when the pushing member 14 is abutted on the paper S is reduced by the torsion coil spring 24. Thus, for example, the paper S is prevented from being torn. Thus, unlike the related art, it is not necessary to control a speed to rotate the pushing member 14 downward and a speed to form deflection on the paper S accurately. Thus, when the leading end part of the pushing member 14 is abutted on the deflection part of the paper S while a speed or timing to rotate the pushing member 14 downward is made higher or earlier than a speed to form the deflection on the paper S, it becomes possible to push the deflection part of the paper S adequately toward the pair of folding rollers 13*a* and 13*b* by the pushing member 14.

Figure 5:
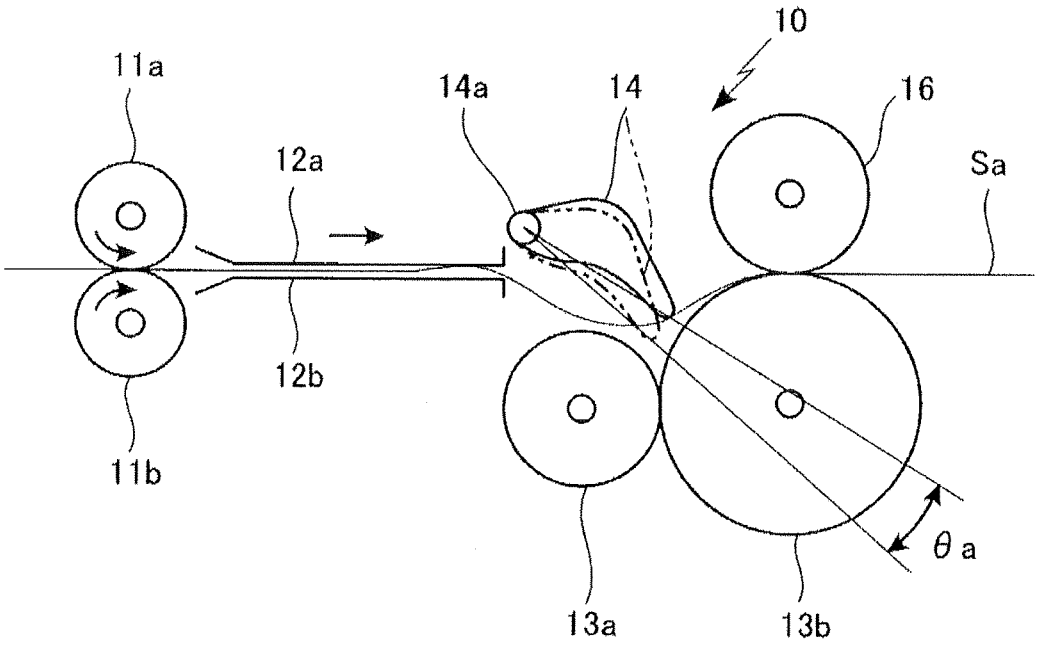
FIG. 5 is a schematic side view illustrating a state in which a deflection part formed on thin paper is pushed toward the gap between the pair of folding rollers by the pushing member in the paper folding apparatus according to the embodiment.

Here, in a case where thin paper Sa having low basis weight and low stiffness is used, as illustrated in FIG. 5, when deflection is formed between the pair of folding rollers 13*a* and 13*b* by the rotations of the upstream-side feeding rollers 11*a* and 11*b* rotations of which are stopped later as described above, deflection of the paper Sa which deflection is formed between the upstream-side feeding rollers 11*a* and 11*b* and the upstream-side guiding members 12*a* and 12*b* or between the upstream-side guiding members 12*a* and 12*b* becomes small and deflection formed between the pair of folding rollers 13*a* and 13*b* becomes large.

Then, in this state, as described above, when the rotation of the rotation transmission shaft 23 is transmitted to the rotary shaft 14*b* of the pushing member 14 via the torsion coil spring 24 and the pushing member 14 is rotated downward, the rotary shaft 14*b* of the pushing member 14 is rotated along with the rotation of the rotation transmission shaft 23 until the leading end part of the pushing member 14 touches the deflection part of the paper Sa, and the pushing member 14 is rotated downward. When the leading end part of the pushing member 14 touches the deflection part of the paper Sa, a load is applied between the rotation transmission shaft 23 and the rotary shaft 14*b* of the pushing member 14. By the rotation of the rotation transmission shaft 23, the torsion coil spring 24 is twisted and the rotary shaft 14*b* of the pushing member 14 is rotated while being biased by torsion force of the torsion coil spring 24, whereby the pushing member 14 is rotated to a predetermined position to be stopped by the stopper (not illustrated).

Here, as described above, when the thin paper Sa is used, deflection formed between the pair of folding rollers 13*a* and 13*b* is large. Thus, a rotation angle until the leading end part of the pushing member 14 touches the deflection part of the paper Sa becomes large. An angle θa of rotation from a position where the leading end part of the pushing member 14 touches the deflection part of the paper Sa to the predetermined position where the pushing member 14 is stopped by the stopper (not illustrated) while being biased by torsion force of the torsion coil spring 24 is small. Force to bias the pushing member 14 which force is applied due to the torsion force of the torsion coil spring 24 is small, and thus, the thin paper Sa is not torn.

Figure 6:
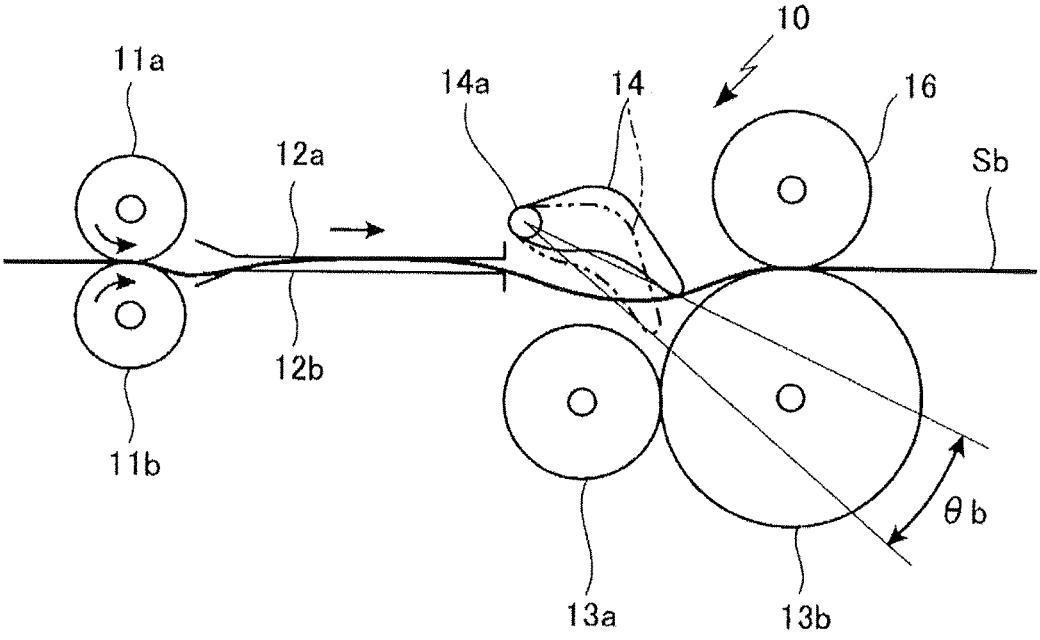
FIG. 6 is a schematic side view illustrating a state in which a deflection part formed on thick paper is pushed toward the gap between the pair of folding rollers by the pushing member in the paper folding apparatus according to the embodiment.

On the other hand, in a case where thick paper Sb having high basis weight and high stiffness is used, as illustrated in FIG. 6, when deflection is formed between the pair of folding rollers 13*a* and 13*b* by the rotations of the upstream-side feeding rollers 11*a* and 11*b* rotations of which are stopped later as described above, deflection of the paper Sb which deflection is formed between the upstream-side feeding rollers 11*a* and 11*b* and the upstream-side guiding members 12*a* and 12*b* or between the upstream-side guiding members 12*a* and 12*b* becomes large and deflection formed between the pair of folding rollers 13*a* and 13*b* becomes small.

Then, in this state, as described above, similarly to the case of using the thin paper Sa, when the rotation of the rotation transmission shaft 23 is transmitted to the rotary shaft 14*b* of the pushing member 14 via the torsion coil spring 24 and the pushing member 14 is rotated downward, the rotary shaft 14*b* of the pushing member 14 is rotated along with the rotation of the rotation transmission shaft 23 until the leading end part of the pushing member 14 touches the deflection part of the paper Sa, and the pushing member 19 is rotated downward. When the leading end part of the pushing member 14 touches the deflection part of the paper Sa, a load is applied between the rotation transmission shaft 23 and the rotary shaft 14*b* of the pushing member 14. By the rotation of the rotation transmission shaft 23, the torsion coil spring 24 is twisted and the rotary shaft 14*b* of the pushing member 14 is rotated while being biased by torsion force of the torsion coil spring 24; whereby the pushing member 14 is rotated downward to the predetermined position to be stopped by the stopper (not illustrated).

Here, when the thick paper Sb is used, deflection formed between the pair of folding rollers 13*a* and 13*b* is small compared to the case of using the thin paper Sa. Thus, a rotation angle until the leading end part of the pushing member 14 touches the deflection part of the paper Sb becomes small compared to the case of using the thin paper Sa. Also, an angle θb of rotation from a position where the leading end part of the pushing member 14 touches the deflection part of the paper Sb to a predetermined position where the pushing member 14 is stopped by the stopper (not illustrated) while being biased by torsion force of the torsion coil spring 24 becomes larger than the angle θa of when the thin paper Sa is used. Thus, force to bias the pushing member 14 due to the torsion force of the torsion coil spring 24 becomes large and deflection part on the thick paper Sb can be guided adequately to the gap between the pair of folding rollers 13*a* and 13*b* by the pushing member 14.

Note that a method to rotate the pushing member 14 by the drive unit 20 via the elastic member is not limited to what has been described in the above embodiment.

Figure 7A:
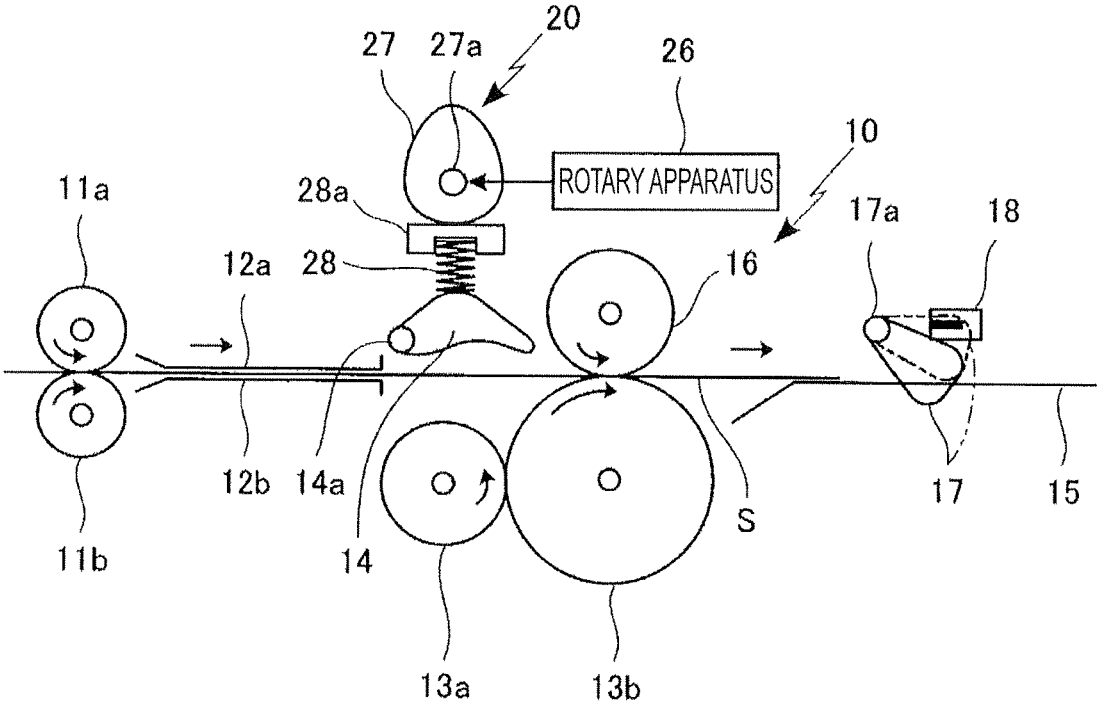
FIG. 7A and FIG. 7B are views illustrating a modification of a configuration to rotate a pushing member by a drive unit via an elastic member in the paper folding apparatus according to the embodiment, FIG. 7A being a schematic side view illustrating a state in which the pushing member is retracted on an upper side of a carrying path of paper and the paper is carried to a downstream-side guiding member and FIG. 7B being a schematic side view illustrating a state in which the retracted pushing member is rotated downward and a deflection part of the paper is pushed toward a gap between a pair of folding rollers by a leading end part of the pushing member.
Figure 7B:
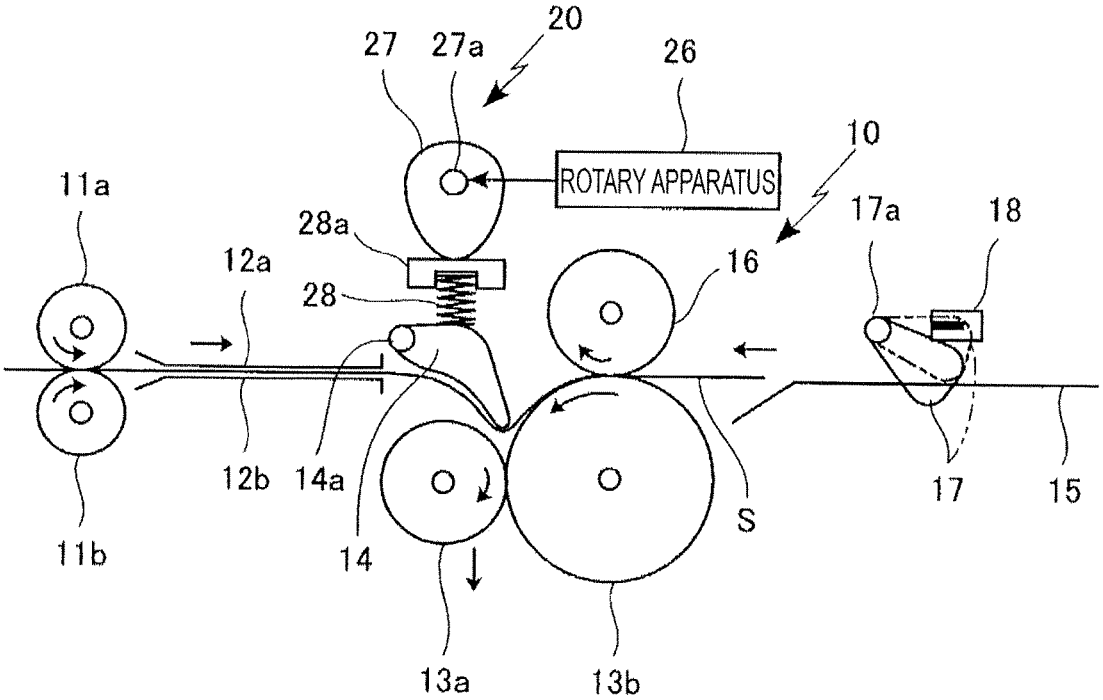

For example, as illustrated in FIG. 7A and FIG. 7B, it is possible to provide, on an upper side of a pushing member 14, a cam 27 rotated by a rotary apparatus 26, to provide a coil spring 28 which is an elastic member between the cam 27 and the pushing member 14, and to make a receiving member 28*a* of the coil spring 28 abutted on an outer periphery of the cam 27.

Then, as illustrated in FIG. 7A, until paper S is carried to a predetermined position as described above, an outer peripheral part of the cam 27 which part is close to a shaft 27*a* of the cam 27 is abutted on the receiving member 28*a* and the pushing member 14 is kept retracted on an upper side of a carrying path of the paper S.

On the other hand, as illustrated in FIG. 7B, when the pushing member 14 is rotated downward and a deflection part of the paper S is pushed toward a gap between a pair of folding rollers 13*a* and 13*b* by a leading end part of the pushing member 14, the cam 27 is rotated by the rotary apparatus 26 and an outer peripheral part of the cam 27 which part is away from the shaft 27*a* of the cam 27 is abutted on the receiving member 28*a*. Then, the coil spring 28 between the cam 27 and the pushing member 14 is compressed. By biasing force of the coil spring 28, the pushing member 14 is rotated downward and the deflection part of the paper S is pushed toward the gap between the pair of folding rollers 13*a* and 13*b* by the leading end part of the pushing member 14.

Even in such a case, similarly to the above case, even when a speed to rotate the pushing member 14 downward becomes higher than a speed to form deflection on the paper S, impact force of when the pushing member 14 is abutted on the paper S is reduced by the coil spring 28. Thus, for example, the paper S is prevented from being torn. Thus, unlike the related art, it is not necessary to control a speed to rotate the pushing member 14 downward and a speed to form deflection on the paper S accurately. Thus, when the leading end part of the pushing member 14 is abutted on the deflection part of the paper S while a speed or timing to rotate the pushing member 14 downward is made higher or earlier than a speed to form the deflection on the paper S, it becomes possible to push the deflection part of the paper S adequately toward the pair of folding rollers 13*a* and 13*b* by the pushing member 14.

Also, in the above embodiment, the deflection part of the paper S is folded in the nip of the pair of folding rollers 13*a* and 13*b* by rotating the pushing member 14 downward and by pushing the deflection part of the paper S toward the gap between the pair of folding rollers 13*a* and 13*b* by the leading end part of the pushing member 14. However, although not illustrated, in a case where the paper S is not to be folded, the paper S carried through the gap between the upstream-side guiding members 12*a* and 12*b* can be guided, while the pushing member 14 is rotated downward, to the gap between the pair of folding rollers 13*a* and 13*b* along the curved surface of the pushing member 14 which surface corresponds to an outer peripheral surface of the folding roller 13*a* on the upstream side in the carrying direction of the paper S.

Also, in the above embodiment, the folding roller 13*b* on the downstream side in the carrying direction of the paper S in the pair of folding rollers 13*a* and 13*b* and the downstream-side feeding roller 16 are used as a downstream-side carrying unit. However, instead of the folding roller 13*b*, a different feeding roller (not illustrated) can be provided.

Note that in the above embodiment, as a method to make deflection on paper, rotations of the upstream-side feeding rollers 11*a* and 11*b* are stopped shortly after rotations of the folding roller 13*b* on the downstream side in the carrying direction of the paper S and the downstream-side feeding roller 16 are stopped, whereby adequate deflection is formed on the paper S between the pair of folding rollers 13*a* and 13*b*. However, the above is not the limitation. For example, deflection may be formed on paper by changing shapes of the upstream-side guiding members 12*a* and 12*b* arranged on a downstream-side of the rollers 11*a* and 11*b* in such a manner that a leading end of the paper moves toward the gap between the folding rollers 13*a* and 13*b*. Although the present invention has been described and illustrated in detail, it is clearly understood that the same is by way of illustrated and example only and is not to be taken by way of limitation, the scope of the present invention being interpreted by terms of the appended claims.

According to an embodiment of the present invention, in an paper folding apparatus as described above, a pushing member retracted from a carrying path of paper is moved toward a nip part of folding rollers by a drive unit via an elastic member and a deflection part of the paper is pushed by a pushing member toward the nip part of the folding rollers due to elastic force of an elastic member deformed by the drive unit. Thus, with a simple configuration, it becomes possible to fold various kinds of paper adequately at a predetermined position.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A paper folding apparatus comprising:

a pair of folding rollers driven in a rotational manner;

a carrying roller configured to carry paper in such a manner that the paper passes near a nip part of the pair of folding rollers;

a pushing member which is configured to push the paper, which is carried by the carrying roller, toward the nip part of the folding rollers, the pushing member being provided in a manner movable from a position retracted from a carrying path of the paper toward the nip part;

a drive unit configured to generate driving force to move the pushing member;

a driven member driven by the drive unit; and a spring member having one end attached to the driven member and another end attached directly to a portion of the pushing member that moves when the pushing member moves, the spring member configured to transmit the driving force from the drive unit to the pushing member, wherein the drive unit and the driven member are on the same side with respect to the spring member.

2. The paper folding apparatus according to claim 1, wherein the pushing member is provided in a manner rotatable with a fulcrum point as a center.

3. The paper folding apparatus according to claim 1, further comprising, relative to the pair of folding rollers, an upstream-side carrying roller provided on an upstream side in a carrying direction of the paper and a downstream-side carrying roller provided on a downstream side in the carrying direction, wherein deflection is formed at a part of the paper placed between the pair of folding rollers by driving the upstream-side carrying roller in the carrying direction of the paper and driving the downstream-side carrying roller in a direction opposite to the carrying direction of the paper in a state in which the upstream-side carrying roller and the downstream-side carrying roller are driven in the carrying direction of the paper and the paper is carried to a predetermined position.

4. The paper folding apparatus according to claim 1, further comprising a guide provided on an upstream side of the pair of folding rollers, wherein a shape of the guide is formed in such a manner that a leading end of the paper moves toward the nip part between the pair of folding rollers.

5. The paper folding apparatus according to claim 1, wherein a surface of the pushing member which surface faces at least one of the folding rollers is a curved surface corresponding to an outer peripheral surface of the folding roller.

6. An image forming apparatus comprising the paper folding apparatus according to claim 1.

7. The paper folding apparatus according to claim 1, wherein the pushing member is pivotable toward the nip part from the position retracted from the carrying path.

8. The paper folding apparatus according to claim 1, further comprising, relative to the pair of folding rollers, an upstream-side carrying roller provided on an upstream side in a carrying direction of the paper and a downstream-side carrying roller provided on a downstream side in the carrying direction, wherein deflection is formed at a part of the paper placed between the pair of folding rollers by driving the upstream-side carrying roller in the carrying direction of the paper in a state in which the upstream-side carrying roller and the downstream-side carrying roller are driven in the carrying direction of the paper and the paper is carried to a predetermined position, and the driving of the downstream-side carrying roller is then stopped.

9. The paper folding apparatus according to claim 1, further comprising:

a cam that is rotated by the drive unit, wherein the driven member is a receiving member that is abutted on an outer periphery of the cam, and the spring member is a coil spring having the one end attached to the receiving member and the other end attached to the pushing member.

10. A paper folding apparatus comprising:

a pair of folding rollers driven in a rotational manner;

a carrying roller configured to carry paper in such a manner that the paper passes near a nip part of the pair of folding rollers;

a unit configured to form, near the nip part, deflection of the paper carried by the carrying roller toward the nip part;

a pushing member which is configured to push the paper, which is carried by the carrying roller, toward the nip part of the folding rollers, the pushing member being provided in a manner movable from a position retracted from a carrying path of the paper toward the nip part;

a drive unit configured to generate driving force to move the pushing member; and an elastic member configured to transmit the driving force from the drive unit to the pushing member, wherein the pushing member is provided in a manner rotatable with a fulcrum point as a center, and wherein a torsion coil spring is used as the elastic member, rotation caused by the drive unit is transmitted, via the torsion coil spring, to the pushing member which rotates with the fulcrum point as the center, and a deflection part of the paper is pushed toward the nip part of the folding rollers by the pushing member due to torsion force of the torsion coil spring twisted by the rotation caused by the drive unit.

* * * * *